US007816628B2

(12) United States Patent
Fernandez et al.

(10) Patent No.: US 7,816,628 B2
(45) Date of Patent: Oct. 19, 2010

(54) HEATED GARMENT

(75) Inventors: Juan Fernandez, Towaco, NJ (US); Paul McGrath, Towaco, NJ (US); Frank Cipolla, Matawan, NJ (US); James Sabastian, Unionville, NY (US); Michael J. Keating, Hardwick, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 615 days.

(21) Appl. No.: 11/604,182

(22) Filed: Nov. 22, 2006

(65) Prior Publication Data

US 2008/0116189 A1 May 22, 2008

(51) Int. Cl.
*H05B 3/00* (2006.01)
*H05B 3/34* (2006.01)

(52) U.S. Cl. ..... 219/211; 219/200; 219/212; 219/217; 219/527; 219/528; 219/529; 219/545; 219/549

(58) Field of Classification Search ..... 219/200, 219/211–2, 217, 527–529, 545, 549
See application file for complete search history.

(56) References Cited

U.S. PATENT DOCUMENTS

| | | | | |
|---|---|---|---|---|
| 710,429 | A | 10/1902 | Collins et al. | |
| 1,358,509 | A | 11/1920 | Birkenfeld | |
| 2,329,766 | A | 9/1943 | Jacobsen | |
| 2,458,119 | A | 1/1949 | Van Daam | |
| 2,579,383 | A | 12/1951 | Goudsmit | |
| 3,084,241 | A | 4/1963 | Carrona | |
| 3,501,616 | A | 3/1970 | Arron | |
| 3,729,613 | A | 4/1973 | Deloire et al. | |
| 3,751,620 | A | 8/1973 | Yuasa | |
| 3,858,028 | A | 12/1974 | Kerr | |
| 3,999,037 | A | 12/1976 | Metcalf, Sr. | |
| 4,404,460 | A | 9/1983 | Kerr | |
| 5,008,517 | A | 4/1991 | Brekkestran et al. | |
| 5,032,705 | A | 7/1991 | Batcheller et al. | |
| 5,105,067 | A * | 4/1992 | Brekkestran et al. | 219/497 |
| 5,893,991 | A | 4/1999 | Newell | |
| 5,977,517 | A | 11/1999 | Grosjean | |
| 5,986,243 | A | 11/1999 | Campf | |
| 6,049,062 | A | 4/2000 | Jones | |
| 6,078,025 | A | 6/2000 | Yeung | |
| 6,329,638 | B1 * | 12/2001 | Bloodworth | 219/211 |
| 6,389,681 | B1 * | 5/2002 | Rock et al. | 29/611 |
| 6,545,253 | B2 | 4/2003 | Lin et al. | |
| 6,649,873 | B1 * | 11/2003 | Cintron et al. | 219/211 |
| 6,840,955 | B2 * | 1/2005 | Ein | 607/108 |

(Continued)

*Primary Examiner*—Shawntina Fuqua
(74) *Attorney, Agent, or Firm*—Lerner, David, Littenberg, Krumholz & Mentlik, LLP

(57) ABSTRACT

In an embodiment of the present invention, a garment includes a fabric having a channel, a heat conductive wire disposed in the channel, a power source coupled to the heat conductive wire and detachably attached to the garment, and a controller electrically coupled to the power source and detachably attached to the garment, wherein the controller is configured with a heat setting. In another embodiment of the present invention, a method of heating a garment includes providing a fabric, forming a channel, disposing a heat conductive wire within the channel, connecting the heat conductive wire with a power source, wherein the power source is a rechargeable battery, and adjusting the heating of the garment by operating the power source and the heat conductive wire using a controller.

53 Claims, 5 Drawing Sheets

U.S. PATENT DOCUMENTS

2002/0088788 A1 7/2002 West
2004/0045955 A1 3/2004 Rock et al.
2005/0016982 A1 1/2005 Campf et al.
2005/0172950 A1 8/2005 Aisenbrey
2006/0001727 A1 1/2006 Haas et al.
2008/0083720 A1* 4/2008 Gentile et al. ..... 219/211

* cited by examiner

HEATED GARMENT

BACKGROUND OF THE INVENTION

The present invention relates generally to heated garments.

There are many instances where a user requires more warmth during cold weather than that provided by conventional garments. For instance, soldiers out in the field, spectators watching an outside sporting event or bikers riding their motorcycles.

Accordingly, it is desirable to provide garments that may supply the additional warmth required by such users. It is also desirable to provide this warmth for extended periods, as the user may be outside during cold weather for long periods of time. Further, it is desirable to provide the garment user the ability to control the amount of warmth the garment generates.

SUMMARY OF THE INVENTION

The foregoing needs are met, to a great extent, by the present invention, wherein the invention provides an improved heated garment. The heated garment is powered by batteries that may be rechargeable. The heated garment has a controller whereby a user may control the level of heat provided. Further, the heated garment may include a timer and a temperature sensor.

In an embodiment of the present invention, a garment is provided that includes a fabric having a channel, a heat conductive wire disposed in the channel, a power source coupled to the heat conductive wire and detachably attached to the garment, and a controller electrically coupled to the power source and detachably attached to the garment, wherein the controller is configured with a heat setting.

In another embodiment of the present invention, a method of heating a garment includes providing a fabric, forming a channel, disposing a heat conductive wire within the channel, connecting the heat conductive wire with a power source, wherein the power source is a rechargeable battery, and adjusting the heating of the garment by operating the power source and the heat conductive wire using a controller.

In yet another embodiment of the present invention, a garment includes a heat conductive wire, a first layer and a second layer adhered to the heat conductive wire wherein the first layer comprises a channel configured to retain the heat conductive wire, a power source detachably coupled to the heat conductive wire, a controller detachably coupled to the power source and the heat conductive wire, and a timer coupled to the controller.

In still another embodiment of the present invention, a garment, includes a fabric having a channel, a heat conductive wire disposed in the channel, a power source coupled to the heat conductive wire and detachably attached to the garment, a controller electrically coupled to the power source and detachably attached to the garment, wherein the controller is configured with a heat setting, and a temperature sensor coupled to the controller.

In another embodiment of the present invention, a method of heating a garment, includes providing a fabric, forming a channel in the fabric, disposing a heat conductive wire within the channel, connecting the heat conductive wire with a power source, wherein the power source is a rechargeable battery, measuring a temperature with a temperature sensor, and adjusting the heating of the garment by operating the power source and the heat conductive wire using a controller.

DETAILED DESCRIPTION

Figure 1:
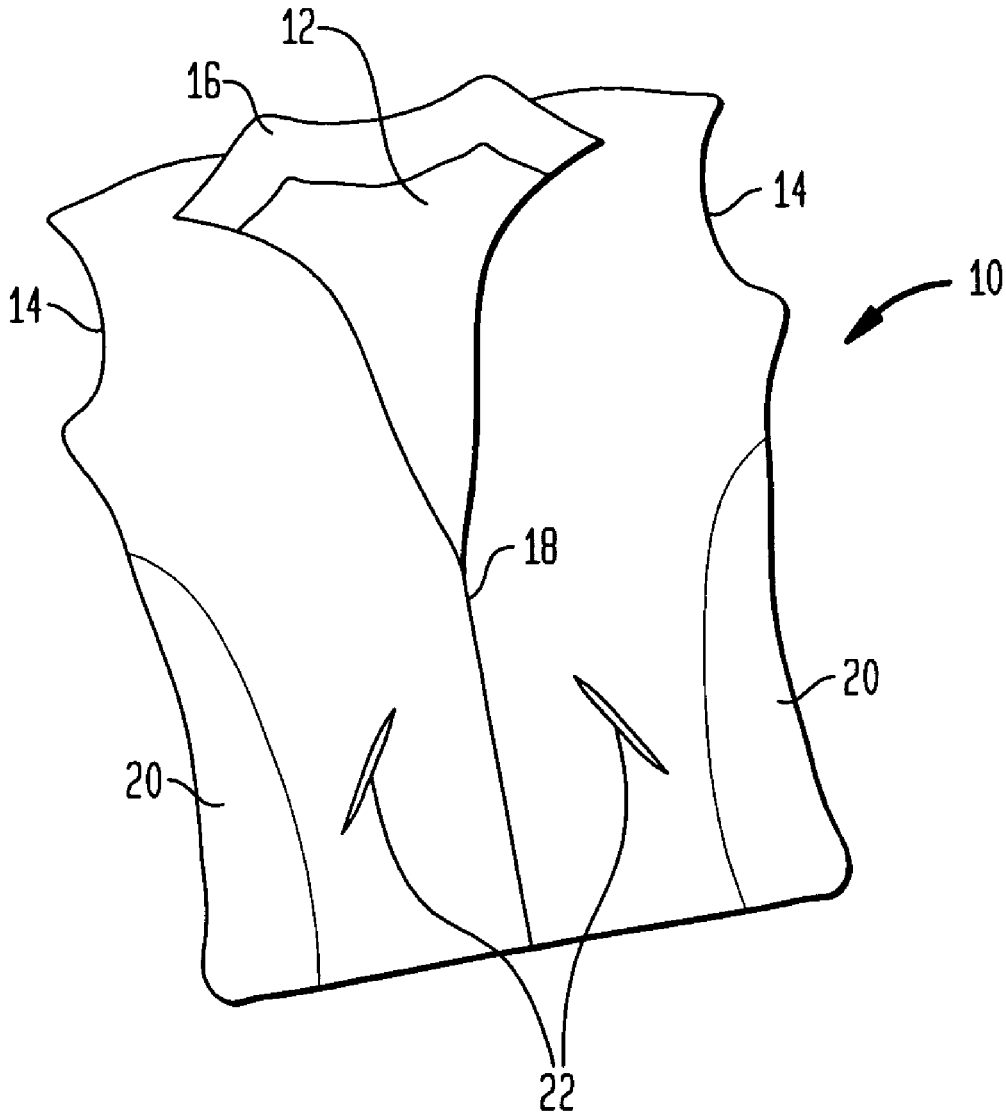
FIG. 1 is a front view of a heated garment according to one embodiment of the present invention.

FIG. 1 is a top view of a heated garment 10. The heated garment 10, in this embodiment, includes a neck opening 12 and arm openings 14. The neck opening 12 may include a collar 16. The heated garment 10 also has a fastener 18 that a user may use to close the heated garment 10 around his or her torso. In certain embodiments, the fastener 18 may be a zipper, Velcro™, or the like.

Further, the heated garment 10 may have a side panel 20 at both sides. The side panels 20 may be formed of a different material than that used for the remainder of the heated garment 10. In an embodiment of the present invention the side panels 20 may be formed of a stretchable material such as spandex or Lycra®. These side panels 20 preferably allow for a more snug fit, which may prevent heat loss of both the heat created by garment 10 and that of its user.

The heated garment 10 may also include various external pockets 22 for a user to place their hands or other objects in. The heated garment 10 may also include various internal pockets to house and retain various components of the heated garment 10.

The heated garment 10 may also include drawstrings (not shown) that assist in tightening the heated garment 10 against a user's body. This also prevents excessive heat loss through an opening that may otherwise be created between the user and the heated garment 10. These drawstrings may be utilized in conjunction with the aforementioned-side panels 20 to further reduce heat loss.

In an embodiment of the present invention, the heated garment 10 includes at least two layers. For example, there may be a top or external layer and a bottom or internal layer. Although two layers are mentioned, any number of layers may be used, even a single layer. The external layer is generally cotton and the internal layer is generally nylon, however it is to be understood that any appropriate material may be used. Further, the heated garment 10 may include an insulative layer, preferably using materials that have a high or dense fiber content that reduce airflow or heat loss. Some materials that may be used include down, Polarguard®, Hallofill, Thinsulate™, Dacron® or wool. The material may also be flame-retardant.

Ideally, a thinner or less insulative material will be placed on the above-discussed internal layer, adjacent the user's body. This facilitates efficient heat transfer from the heating system to the user's body. Further, a thicker, more insulative material may be used for the outer layer. This insulative, thicker outer layer preferably prevents heat from escaping to the outside and allows the heated garment 10 to be more effective in warming the user.

Because the heated garment 10 will be worn during the cold months, the likelihood of precipitation is high, as with snow. As such, the heated garment 10 will preferably be water resistant or water proof. Further, the heated garment 10 may be washed easily. In yet another embodiment of the present invention, the outer layer of the heated garment 10 may be made of a reflective material such that the user will be easily seen in the dark. Certain parts of the garment may also be covered with the reflective material. Example waterproof materials include oilskins, polyvinyl chloride or PVC, urethane coated nylons, sealcoat or rubber. Example water resistant materials include Gortex®, Hellytech®, nylons and waxed leather.

Although a vest type garment is depicted and discussed herein, the heated garment 10 may take any form desired. For instance, the heated garment 10 may be a full sleeve garment, a cap, gloves, pants or socks. Any type of garment is within the scope of this invention. In addition, the combination of two or more garments is also contemplated in accordance with the present invention. For example, a vest or jacket type garment could be coupled with a hat, pair of gloves, and/or pants. Thus, a full or partial body covering garment falls within the scope of the present invention.

Figure 2:
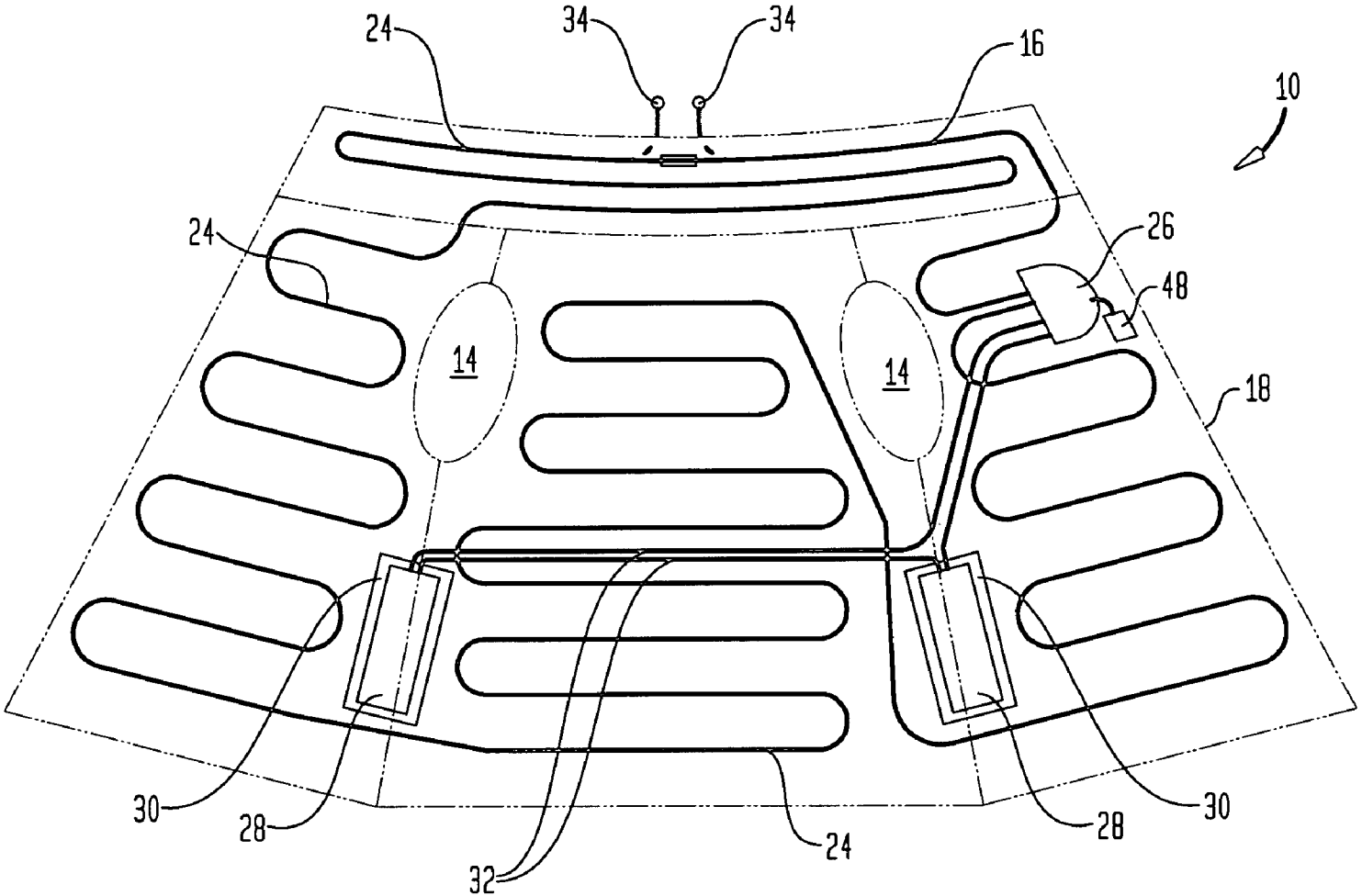
FIG. 2 is a schematic illustration of a heating system of the heated garment of FIG. 1.

FIG. 2 is a schematic illustration of the heated garment 10, with attention to the heating system of the garment. The heated garment 10 generally includes heat conductive wires 24 that provide the necessary heat for to the user. In an embodiment of the present invention, there may be one wire 24 that is looped around in a particular manner throughout the heated garment 10, or, in other embodiments, the heated garment 10 may contain various wires 24 that are placed throughout the heated garment 10. These wires may then be placed in series or in parallel as desired. Materials for the heat conductive wires 24 include any conductive metal. For instance, copper and aluminum are suitable. The heat conductive wires 24 may be encased in a tubing or the like.

In the embodiment depicted in the figures, a wire 24 is placed throughout the heated garment 10 and couples to a controller 26. Further, the wire 24 is coupled, via the controller 26, to a battery pack 28. There may be one or more battery packs 28, as desired.

In the particular embodiment shown, the heated garment 10 includes two battery packs 28 placed adjacent the side panels 20. In particular, the battery packs 28 are placed inside internal pockets 30 formed in the heated garment 10. The internal pockets 30 are sized and configured to receive the battery packs 28, and are preferably sized to retain the battery packs 28 in a tight manner with or without the use of a flap (not shown) to close the internal pockets.

In one embodiment, the internal pockets 30 have a closure which may include a flap to close the internal pockets 30. The flap may include a fastener such as buttons, Velcro™ or a zipper. Any other type of fastener may also be used.

Placing the battery packs 28 adjacent the side panels 20 ensures that the battery packs 28 do not hinder the user in any way. For instance, the external pockets 22 may be placed more forward for the user's convenience so that the battery packs 28 will not interfere with these external pockets 22. The placement of the battery packs 28 also provides for easy access to the battery packs 28 when the battery packs 28 need to be recharged. For instance, a user may use one hand to easily remove the battery pack located by the other hand. Although the battery packs 28 shown have been placed adjacent the side panels 20, it should be noted that they may be placed wherever desired.

The battery packs 28 are connected to battery pack wires 32 to transmit power from the battery packs 28 to the controller 26. The battery pack wires 32 are conductive. Positive and negative terminals of the battery pack wires 32 may be detachably connected to both the controller 26 and the battery packs 28. These wires 32 carry current to the controller 26 and the controller 26 behaves as a switch or a gateway. The controller 26 to passes the current to the heat conductive wires 24 using a timing circuit.

The wires 24 in the depicted embodiment are placed in a generally horizontal manner throughout the heated garment 10. When using a single wire 24, the wire 24 may be looped around and have generally longer horizontal pieces than vertical pieces. This is best shown in FIG. 2. The horizontal nature of the placement of the wires 24 results in a more efficient warming of the user of the heated garment 10. Specifically, the horizontal placement of the wires 24 builds up the heat better than other configurations. Heat running from horizontal wires builds up from a lower rung of heat to a higher rung of heat because heat rises. This enables a better heat distribution. Vertical placement of wires is not as efficient in providing warmth because, as heat rises, it rises only along the vertical wires, creating vertical dead spots where the user does not feel any heat. However, the wires 24 may be placed in any fashion within garment 10 as desired.

Generally the wires 24 are sewn into either the internal or external layer. In an embodiment of the present invention, channels (not shown) are formed in either layer. Channels may also be formed by attaching one layer to the other layer. These channels may be formed by sewing, for example. Preferably the channels are formed in a generally horizontal fashion. In certain embodiments, the channels may also be formed with vertical portions for looping wire 24.

Once these channels are formed in the fabric, the wires 24 are led through each channel. A guide may be used to lead the wires 24 through these channels. Thus, these channels retain the wires 24 and prevent them from being displaced within the heated garment 10 when worn. The wires may also be attached to either layer using an adhesive or the like, with or without the use of similar channels.

The wires 24 may also be placed in a tighter pattern in certain core areas, such as the lower back. These core areas may be created by forming channels in a tighter pattern or simply attaching wires 24 in such a tighter pattern. Thus, there may be areas of uniform heating and areas of non-uniform heating. Keeping certain core areas of the body at a warmer temperature keeps the user feeling generally warm all over. This also extends battery life in that the user may not need to leave the heated garment 10 on a high heat setting for long periods of time, which may drain the battery pack 28. Additional core areas include the chest or abdomen, that include vital organs such as the kidneys, the heart or lungs.

The wires 24 may also extend up to the collar 16, thus ensuring that the user's neck is also kept warm. The collar 16 may also have fasteners 34 for attaching a detachable hood (not shown) to the heated garment 10. The detachable hood may also be heated in a manner similar to that of the heated garment 10. Fasteners similar to fasteners 34 may be placed at other locations on the heated garment 10. For instance, fasteners 34 may be placed on long sleeves to couple to gloves. Fasteners 34 may also be placed by the waist of the heated garment 10 to couple to pants or the like. In an embodiment of the present invention, the fasteners 34 may behave as electrical contacts to simultaneously heat the hood and the heated garment 10, without the hood having its own separate power and controller. Thus, fasteners on the hood acting as electrical contacts may couple with fasteners 34 on the heated garment 10 and may be heated thereby.

Thus, the fasteners 34 may be formed of any electrically conductive type of material, such as metal. In like manner, the heated garment 10 may be fastened to gloves, scarves, undergarments, pants or socks. These other garments may also have corresponding electrically conductive fasteners to transfer power and heat to these garments without the use of separate controllers and battery packs. In another embodiment of the present invention, wearable hoods, gloves or socks may be configured having separate controllers and battery packs. The additional garments may be connected to the heated garment 10 either in series or in parallel. In addition to the fasteners 34, other male/female type connectors may also be used to couple additional garments to the heated garment 10. Such couplers or fasteners 34 may then be insulated or hidden within the heated garment 10 when uncoupled.

Additionally, the external pockets 22 may also be supplied with separately controlled wiring such that a user may decided to turn the heat on or off in the external pockets 22. This may be in the form of having separate wires 24 placed near the external pockets 22 that may be independently controlled by the controller 26. Thus, the user may be able to turn the external pockets 22 on or off. This would extend the battery life further.

In another embodiment of the present invention, a separate packet of heat conductive wires 24 may be inserted into the external pockets and coupled to the heated garment 10. This packet may then be attached to the external pocket 22 by conventional means and include male or female couplers to connect the packet to the controller 26 or battery pack 28. The packet may then be operated by the controller 26 and be powered by the battery pack 28. It may also be configured such that the user is able to turn the packet on while keeping the remainder of the heated garment 10 off.

Figure 3:
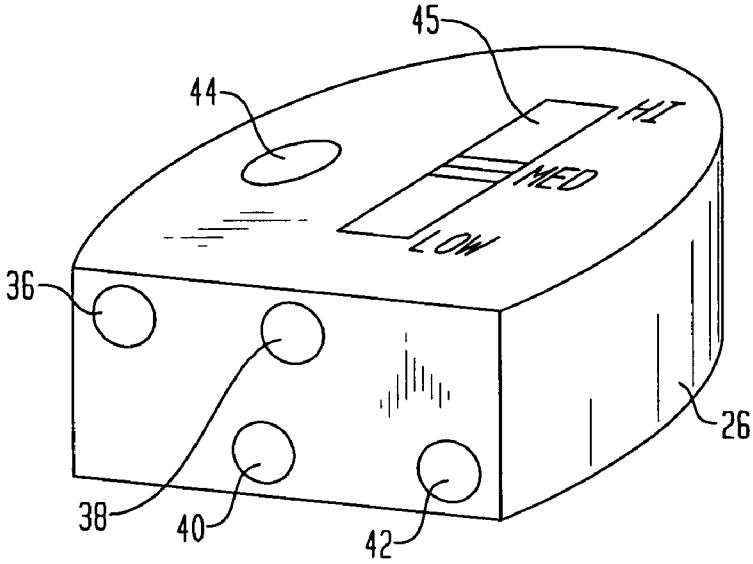
FIG. 3 is a perspective view of a controller for use with the heated garment of FIG. 1.

FIG. 3 is a perspective view of one embodiment of a controller 26 for use with heated garment 10. In an embodiment of the present invention, the controller 26 includes a variable pulse width modulation circuit of varying time for turning current flow on or off. The controller 26 generally has various terminals, or plugs for input, such as positive and negative, although any configuration may be utilized as needed. A first battery terminal 36 and a second battery terminal 38 may be configured to electrically couple to the battery packs 28. The battery pack wires 32 may connect together into one connector to couple to the controller 26. The controller 26 may couple to the battery packs 28 using male and female couplers. A heater terminal 40 may couple to the heater wires 24. Alternately, heat conductive wires 24 may also form a loop and couple to the controller 26 at one point. A terminal 42 may be used to couple to a temperature sensor 48 as discussed below.

In the embodiment where a sensor 48 is utilized, the controller 26 may be a comparator type of controller. For instance, the sensor 48 may be a circuit module that compares the temperature variable analog voltage or current through a resistor input of temperature provided by the sensor 48 and compares that value against a set point reference. The set point reference is established as the target heat level which determines whether the heat element is being provided input power or is turned off. When the sensor 48 output voltage or current, through a resistor, reaches a level equivalent to or exceeding the reference set point, by some small margin of hysterisis, the comparator output enables or disables the delivery of power to the heating element.

In yet another embodiment of the present invention, the controller 26 may include a proportional ("P"), an integral ("I"), or a derivative ("D") term, or a combination thereof. A proportional, integral, derivative or PID controller includes all three terms, whereas a PD controller includes the proportional and integral terms, for example. The PID controller, or the like, may be implemented in either analog operational amplifier techniques or by way of firmware running on a dedicated embedded microcontroller or microprocessor.

Further, the controller 26 has a first switch 44 to power the heated garment 10 on or off. This first switch 44 may be a push-button type of switch or any type as desired. Further, the controller 26 includes a second switch 45. The second switch 45 may control the amount or level of heat that is generated. For instance, there may be settings for low, medium or high heat as will be described in greater detail below. The second switch 45 may be a sliding switch capable of being moved to a different position. In the alternative, the controller 26 may include additional switches or a single switch that performs both functions, that of turning the power on or off and controlling the level of heat. For example, the controller 26 may have a third switch for enabling or disabling the temperature sensor 48 as discussed below.

Moreover, the controller 26 may have a timer (not shown) configured to automatically power down the heated garment 10 after being powered on for a particular amount of time. This automatic feature prevents the accidental discharge of the battery packs 28 and also prevents the user from being overheated. Once the heated garment 10 powers down, if the user still desires heat, the user may turn the power back on. The timer may be set to power down after thirty, forty or fifty minutes of being on, for instance, although any time period may be used. The timer may also be configured to power the heated garment 10 continuously for the first few minutes, for example three or five minutes, ensuring that the heated garment 10 is heated rapidly and the user feels warm quickly. After a few minutes, the heated garment 10 would pulse according to the setting desired by the user, such as low, medium, or high, described in greater detail below.

Figure 4:
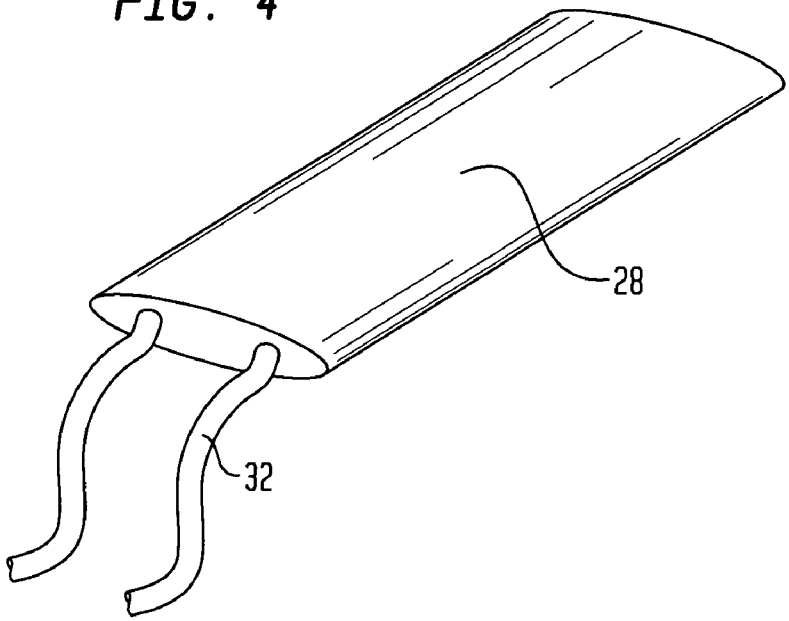
FIG. 4 is a perspective view of a battery pack for use with the heated garment of FIG. 1.

FIG. 4 is a perspective view of a battery pack 28. The battery pack 28 may be any type of power source. The battery pack 28 may be a one-time use type of battery, such as an alkaline battery. The battery pack 28 may also be a rechargeable type of battery such a nickel-cadmium battery, nickel metal hydride battery, lithium-ion type or the like. Furthermore, the heated garment 10 may be configured to be powered by a vehicle's cigarette lighter adapter. In the embodiment where the battery pack 28 is rechargeable, the battery pack 28 may be disposed within a charger 46 that may recharge the battery pack 28.

Figure 5:
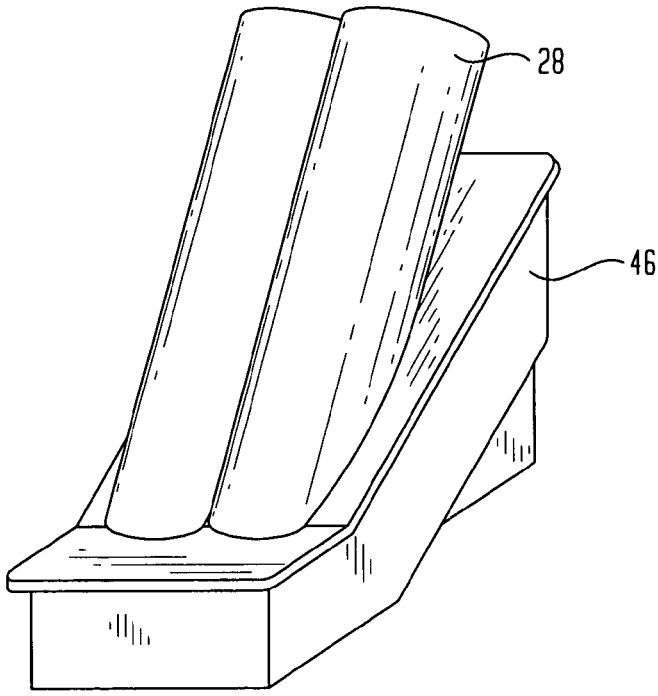
FIG. 5 is a perspective view of the battery of FIG. 4 disposed in a charger for the battery pack.

FIG. 5 is a perspective view of the battery 28 within the charger 46 for the battery pack 28. The charger 46 may be configured to receive the battery pack 28 and may be connected to a wall outlet or to an AC-DC adapter. In other embodiments, the battery pack 28 may be recharged by a vehicle's cigarette lighter adapter. Although a charger 46 holder is depicted, the battery pack 28 may be charged using a direct connection to a wall battery charger having dual leads. The charger 46 may be configured with a battery charge monitor to allow the user to monitor how quickly the battery packs 28 are being recharged.

Figure 6:
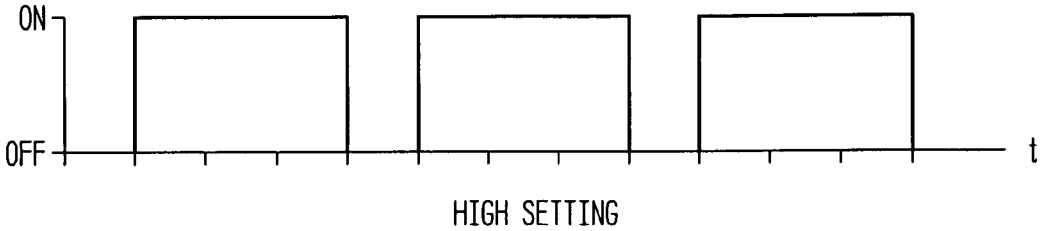
FIG. 6 is a graph depicting a high setting of the heated garment of FIG. 1.

In an embodiment of the present invention, the heated garment 10, through the use of the controller 26, has several settings. For instance, there may be a low, medium and a high setting. This ensures that the user receives the amount of warmth that he or she desires. FIG. 6 is a graph depicting a high setting of the heated garment 10. As is shown in FIG. 6, in the instance where the setting is set to high, the controller 26 powers the heated garment 10 for three seconds and then turns off for one second. Then the power is back on for three seconds and off for one second. This process is repeated. In this manner, the heated garment 10 is not continuously on, which may consume the power of the battery pack 28 very quickly. Pulsing the power on and off as needed reserves some of the life of the battery pack 28, thereby extending the life of the battery pack 28 and extending the amount of time the user can wear the heated garment 10.

Figure 7:
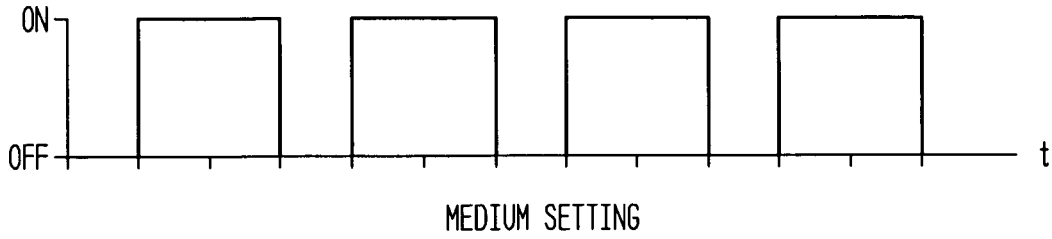
FIG. 7 is a graph depicting a medium setting of the heated garment of FIG. 1.
Figure 8:
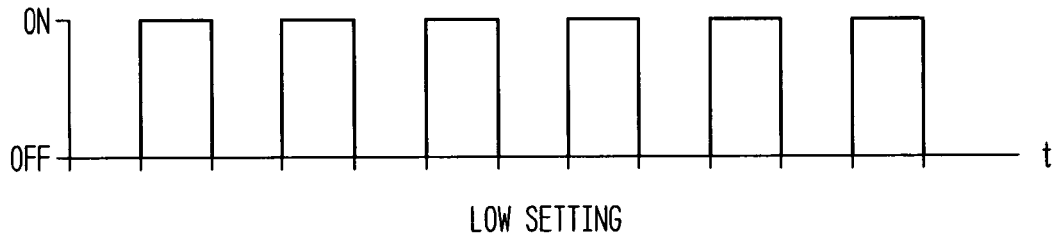
FIG. 8 is a graph depicting a low setting of the heated garment of FIG. 1.

FIG. 7 is a graph depicting a medium setting of the heated garment 10. With this setting, the power is on for two seconds and off for one second. Then the power is back on for two seconds and then off for one second. This setting extends the life of the battery pack 28 even further. FIG. 8 is a graph depicting a low setting of the heated garment 10. In this setting, the power is on for one second and off for one second. This pulsing ability and method provides the user with more control over the amount of warmth generated by the heated garment 10 while simultaneously extending the battery life of the battery pack 28. Although example situations are presented exemplifying time periods where the heated garment 10 is powered on versus off, any variety of pulses may be used for any length of time.

Alternately, rather than a pulsing situation, the amplitude of the heat, or intensity, may be increased or decreased as desired. Further, the modulated signal may also be in the form of a sinusoidal waveform.

Figure 9:
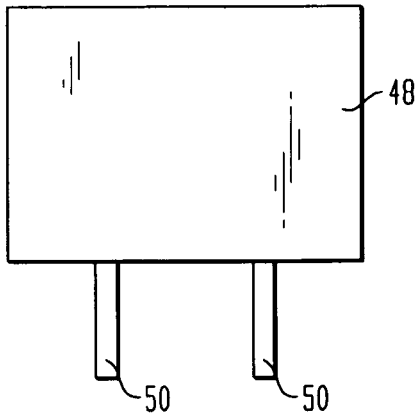
FIG. 9 is a schematic illustration of a temperature sensor for use with the heated garment of FIG. 1.

FIG. 9 is a schematic illustration of a temperature sensor 48. The sensor 48 has wires 50 for coupling to the controller 26 and other components of the heated garment 10. The temperature sensor may be any type of temperature sensor as desired, such as for example, thermistors, thermocouples or resistance temperature detectors. The temperature sensor 48 may be placed adjacent the user's body to detect the temperature of the user to better serve the user's needs. Ideally, the temperature sensor 48 may be placed away from the core areas. For example, the temperature sensor 48 may be placed near the extremities where the user is likely to feel cold faster. Areas such as the neck, armpits or the groin are likely to have the greatest heat loss and thus are more prone to temperature changes. Placing the temperature sensor 48 in those areas would allow for slighter temperature variations to be detected and allow for more efficient adjustments to the temperature.

A sensor 48 having a relay or open or closed configuration may be used. Further, a sensor that provides a fluctuating signal based on the temperature reading may also be used. The signal may be a very small voltage that corresponds to a given temperature that the controller then processes. Another type of sensor that may be used varies its resistance as the temperature changes. In this case, the controller 26 provides a voltage to the sensor and measures the return or change in resistance and processes this information accordingly. Thus, any type of sensor may be used.

Preferably, the temperature sensor 48 measures the amount of heat generated and communicates the information to the controller 26. The controller 26 then may power up or down based on the measured temperature. The controller 26 may also place the heated garment 10 on either the low, medium or high setting as desired. For instance, if the heat is too high, the temperature sensor 48 measures that and communicates this information to the controller 26. The controller 26 may then switch from a high heat setting to a medium or a low heat setting. The controller 26 may also shut the power off.

Furthermore, the sensor 48 may be configured to constantly measure the temperature or at predetermined intervals of time. The sensor 48 may also be such that at a first threshold temperature, a low point, the heated garment 10 begins to function and at a second threshold temperature, the heated garment 10 ceases to function. For instance, it may be that the heated garment 10 will turn on at a first temperature for example and turn off at a second temperature. Thus, when the sensor 48 measures this first temperature, it communicates this reading to the controller 26, which then turns the power on the heated garment 10. The controller 26 will continue heating the heated garment 10 until it reaches the second threshold temperature, a high point. Once the temperature reaches the second threshold or high point, the sensor 48 communicates that to the controller 26 which then turns the power off.

In the alternate, when the two thresholds are reached, rather than turning the power on or off, the controller 26 may pulse the power on or off or use a sinusoidal waveform. If the second threshold or high temperature point is reached, the controller 26 may do nothing and allow the temperature to recede through natural heat loss allowing the heated garment 10 to cool off.

The temperature sensor 48 may also sense an outside temperature or ambient temperature and communicate that to the controller. The controller 26 then may calculate that, along with the thermal properties of the heated garment 10 and regulate the power or heat accordingly. For example, the controller 26 may be configured with data representing the thermal properties of the materials used to fabricate the heated garment 10. Using those properties and the outside temperature, the controller 26 may regulate the heated garment 10.

Although a single sensor 48 is mentioned, the heated garment 10 may have a plurality of sensors placed strategically throughout. For example, there may be a sensor 48 at each core area, enabling the controller to know which core areas are in need of additional or less heat. Further, the heat conductive wire 24 may be configured to independently heat particular areas and can be regulated separately. Thus, for example, there may be a core area by the lower back with its own sensor 48. A second core area may be near the chest with its own sensor 48. The two sensors will allow the controller 26 to regulate the back and chest areas separately. Heat may be required at the lower back while not required at the chest for example, based on the readings gathered by the sensors placed at each of these locations. Although core areas are indicated, the sensors may be placed anywhere as desired.

In a further embodiment of the present invention, if the sensor 48 is used, the timing circuit may be overridden. Moreover, the sensor 48 function may be disabled by the user if desired. For instance, if the user wants the heated garment 10 to be powered on constantly without having it measure the temperature and regulating the heated garment 10, the user may do so. This may be performed by adding another switch to the controller 26 to disable the sensor 48.

The controller 26 may also contain a display indicating the setting of the heated garment 10, for instance through LED lights or the like. The controller 26 may also contain an LED light to indicate whether the sensor 48 is functioning or has been disabled.

In making the heated garment 10 washable, the controller 26, temperature sensor 48, and battery pack 28 may be removable, ensuring that they do not get wet or damaged during the wash. The ends of both the heat conductive wires 24 and the battery pack wires 32 may preferably be capped to prevent the wires from getting damaged. The heat conductive wires 24 and the battery pack wires 32 may have caps that are attached to the wires such that the user may not lose the caps. The caps may also be self sealing such that the wires are sealed with a membrane that allows the insertion of plugs to complete the circuit and when the plugs are removed, the membrane closes off the connectors to make the connectors water tight. Alternatively, the heated garment 10 could be configured such that the inner layer and the outer layer may be detachable from each other. This allows a user to detach the outer layer from the inner layer to wash the outer layer, without damaging the components. In this manner, the inner layer may contain the various components, such as the controller 26 and the battery packs. This would also allow for different types of exteriors to be mixed and matched with the interior. As such, different styles, colors or the like could be exhibited on the outside of heated garment 10 with the heating function of the interior remaining the same.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A garment, comprising:

a fabric having a channel;

a heat conductive wire disposed in the channel;

a power source coupled to the heat conductive wire and detachably attached to the garment;

a controller electrically coupled to the power source and detachably attached to the garment, wherein the controller is configured with a heat setting; and a temperature sensor operably coupled to the controller and detachably attached to the garment, wherein the temperature sensor is configured to be disabled.

2. The garment of claim 1, wherein the channel comprises a plurality of channels.

3. The garment of claim 2, wherein the plurality of channels are placed in a horizontal pattern.

4. The garment of claim 1, wherein the heat setting further comprises a low, a medium and a high setting, and wherein the controller is configured to change the heat setting based on the measured temperature.

5. The garment of claim 1, further comprising a timer operably coupled to the controller and configured to continuously heat the garment for a predetermined period of time, wherein the timer is configured to power off the garment after being powered on for a predetermined period of time.

6. The garment of claim 1, wherein the controller powers on at a first threshold temperature and wherein the controller powers off at a second threshold temperature.

7. A garment, comprising:

a fabric having a channel;

a heat conductive wire disposed in the channel;

a power source coupled to the heat conductive wire and detachably attached to the garment;

a controller electrically coupled to the power source and detachably attached to the garment, wherein the controller is configured with a heat setting, and wherein the controller is configured with data representing thermal properties of the garment; and a temperature sensor operably coupled to the controller and detachably attached to the garment, wherein the temperature sensor measures ambient temperature, wherein the controller is configured to regulate heating of the garment based on the measured ambient temperature and the thermal property data.

8. The garment of claim 7, wherein the channel comprises a plurality of channels.

9. The garment of claim 8, wherein the plurality of channels are placed in a horizontal pattern.

10. The garment of claim 7, wherein the heat setting further comprises a low, a medium and a high setting, and wherein the controller is configured to change the heat setting based on the measured temperature.

11. The garment of claim 7, further comprising a timer operably coupled to the controller and configured to continuously heat the garment for a predetermined period of time, wherein the timer is configured to power off the garment after being powered on for a predetermined period of time.

12. The garment of claim 7, wherein the controller powers on at a first threshold temperature and wherein the controller powers off at a second threshold temperature.

13. The garment of claim 1, further comprising a plurality of temperature sensors operably coupled to the controller and detachably attached to the garment, wherein the plurality of temperature sensors are disposed throughout the garment, and wherein the plurality of temperature sensors are configured to be disabled.

14. A method of heating a garment, comprising:

providing a fabric;

forming a channel in the fabric;

disposing a heat conductive wire within the channel;

connecting the heat conductive wire with a power source, wherein the power source is a rechargeable battery;

measuring ambient temperature using a temperature sensor; and adjusting the heating of the garment by operating the power source and the heat conductive wire using a controller, the controller being configured with data representing the thermal properties of the garment;

wherein the step of adjusting the heating of the garment comprises regulating the heating of the garment based on the measured ambient temperature and the thermal property data.

15. The method of claim 14, wherein the controller comprises a heat setting having a low, a medium and a high heat setting, and wherein adjusting the heating further comprises changing the heat setting based on the measured temperature.

16. The method of claim 15, wherein the high setting comprises heating the garment on for 3 seconds and off for one second.

17. The method of claim 15, wherein the medium setting comprises heating the garment on for 2 seconds and off for one second.

18. The method of claim 15, wherein the low setting comprises heating the garment on for 1 second and off for one second.

19. The method of claim 14, wherein adjusting the heating comprises turning the power on at a first threshold temperature and turning the power off at a second threshold temperature.

20. The garment of claim 1, wherein the temperature sensor is disposed proximate an extremity of the user.

21. The garment of claim 20, wherein the extremity is selected from the group consisting of neck, armpit and groin.

22. The garment of claim 13, wherein at least one of the temperature sensors is disposed proximate a core area of the user.

23. The garment of claim 22, wherein the core area is selected from the group consisting of lower back and chest.

24. A garment, comprising:

a fabric having a channel;

a heat conductive wire disposed in the channel;

a power source coupled to the heat conductive wire and detachably attached to the garment;

a controller electrically coupled to the power source and detachably attached to the garment, wherein the controller is configured with a heat setting; and a plurality of temperature sensors operably coupled to the controller and detachably attached to the garment, wherein the plurality of temperature sensors are disposed throughout the garment;

wherein the heat conductive wire is configured to independently heat a plurality of areas of the garment, each of the plurality of areas being associated with at least one of the plurality of temperature sensors, and wherein the controller is configured to individually regulate heating of the plurality of areas of the garment separately, based on information provided by the associated temperature sensors.

25. The garment of claim 1, wherein the controller comprises a switch for disabling the temperature sensor.

26. The garment of claim 7, wherein the temperature sensor is configured to be disabled.

27. The garment of claim 26, wherein the controller comprises a switch for disabling the temperature sensor.

28. The garment of claim 13, wherein the controller comprises a switch for disabling the temperature sensors.

29. The garment of claim 5, wherein the timer is configured to be overridden when the temperature sensor is enabled.

30. The garment of claim 11, wherein the temperature sensor is configured to be enabled and disabled, wherein the timer is configured to be overridden when the temperature sensor is enabled.

31. A garment, comprising:

a fabric having a channel;

a heat conductive wire disposed in the channel;

a power source coupled to the heat conductive wire and detachably attached to the garment;

a controller electrically coupled to the power source and detachably attached to the garment, wherein the controller is configured with a heat setting; and an external pocket configured to receive a packet of heat conductive wires, the packet being configured to detachably couple to the power source and the controller.

32. The garment of claim 1, wherein the temperature sensor measures ambient temperature.

33. The garment of claim 1, wherein the temperature sensor measures the temperature of the user.

34. A garment, comprising:

a fabric having a channel;

a heat conductive wire disposed in the channel;

a power source coupled to the heat conductive wire and detachably attached to the garment;

a controller electrically coupled to the power source and detachably attached to the garment, wherein the controller is configured with a heat setting; and a temperature sensor operably coupled to the controller and detachably attached to the garment, wherein the temperature sensor is, disposed proximate an extremity of the user.

35. The garment of claim 34, wherein the extremity is selected from the group consisting of neck, armpit and groin.

36. The garment of claim 34, wherein the channel comprises a plurality of channels.

37. The garment of claim 36, wherein the plurality of channels are placed in a horizontal pattern.

38. The garment of claim 34, wherein the heat setting further comprises a low, a medium and a high setting, and wherein the controller is configured to change the heat setting based on the measured temperature.

39. The garment of claim 34, further comprising a timer operably coupled to the controller and configured to continuously heat the garment for a predetermined period of time, wherein the timer is configured to power off the garment after being powered on for a predetermined period of time.

40. The garment of claim 39, wherein the temperature sensor is configured to be enabled and disabled, wherein the timer is configured to be overridden when the temperature sensor is enabled.

41. The garment of claim 34, wherein the controller powers on at a first threshold temperature and wherein the controller powers off at a second threshold temperature.

42. The garment of claim 34, wherein the temperature sensor is configured to be disabled.

43. The garment of claim 42, wherein the controller comprises a switch for disabling the temperature sensor.

44. The garment of claim 24, wherein the channel comprises a plurality of channels.

45. The garment of claim 44, wherein the plurality of channels are placed in a horizontal pattern.

46. The garment of claim 24, wherein the heat setting further comprises a low, a medium and a high setting, and wherein the controller is configured to change the heat setting based on the measured temperature.

47. The garment of claim 24, further comprising a timer operably coupled to the controller and configured to continuously heat the garment for a predetermined period of time, wherein the timer is configured to power off the garment after being powered on for a predetermined period of time.

48. The garment of claim 47, wherein the temperature sensors are configured to be enabled and disabled, wherein the timer is configured to be overridden when the temperature sensors are enabled.

49. The garment of claim 24, wherein the controller powers on at a first threshold temperature and wherein the controller powers off at a second threshold temperature.

50. The garment of claim 24, wherein the temperature sensors are configured to be disabled.

51. The garment of claim 50, wherein the controller comprises a switch for disabling the temperature sensor.

52. The garment of claim 24, wherein at least one of the temperature sensors is disposed proximate a core area of the user.

53. The garment of claim 52, wherein the core area is selected from the group consisting of the lower back and chest.

* * * * *